US007450868B2

(12) United States Patent
Kunikawa

(10) Patent No.: US 7,450,868 B2
(45) Date of Patent: Nov. 11, 2008

(54) DEVELOPMENT DEVICE AND TONER REPLENISHMENT METHOD

(75) Inventor: Norihide Kunikawa, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 354 days.

(21) Appl. No.: 11/455,642

(22) Filed: Jun. 20, 2006

(65) Prior Publication Data

US 2006/0285861 A1 Dec. 21, 2006

(30) Foreign Application Priority Data

Jun. 21, 2005 (JP) ..... 2005-180269

(51) Int. Cl.
*G03G 15/08* (2006.01)

(52) U.S. Cl. ..... 399/27; 399/53; 399/258

(58) Field of Classification Search ..... 399/27, 399/30, 61, 53, 258
See application file for complete search history.

(56) References Cited

U.S. PATENT DOCUMENTS 5,353,102 A 10/1994 Sato et al.
6,516,160 B1 * 2/2003 Rodriguez ..... 399/27
2006/0216046 A1 * 9/2006 Hatakeyama ..... 399/27

FOREIGN PATENT DOCUMENTS

JP 5-165328 A 7/1993
JP 7-92754 A 4/1995
JP 2004-126219 A 4/2004
JP 2006065079 A * 3/2006

* cited by examiner

*Primary Examiner*—Susan S Lee
(74) *Attorney, Agent, or Firm*—Nixon & Vanderhye, P.C.

(57) ABSTRACT

A development device is provided with a development vessel, a toner box, a toner amount detection sensor, and a control section. The development vessel accommodates toner to be supplied to an electrostatic latent image on an image carrier. The toner box replenishes toner into the development vessel. The toner amount detection sensor detects an amount of toner accommodated in the development vessel. The control section calculates an amount of toner to be used during image formation based on density information of an image to be formed and controls an amount per unit of time for replenishing toner from the toner box to the development vessel based on the calculated amount of toner to be used and the amount of toner accommodated detected by the toner amount detection sensor.

9 Claims, 8 Drawing Sheets

DEVELOPMENT DEVICE AND TONER REPLENISHMENT METHOD

CROSS REFERENCE

This Nonprovisional application claims priority under 35 U.S.C. § 119(a) on Patent Application No. 2005-180269 filed in Japan on Jun. 21, 2005, the entire contents of which are hereby incorporated by reference.

BACKGROUND OF THE INVENTION

The present invention relates to a development device that, when forming an image electrographically, changes an electrostatic latent image into a visible toner image using toner inside a development vessel and also relates to a toner replenishment method by which toner that is consumed when forming an image electrographically is replenished in the development vessel of the development device.

In order always to achieve an image having suitable density using electrographic image formation, it is necessary to maintain the amount of toner contained in the development vessel of the development device in a state free from excess and deficiency.

Accordingly, in a development device that uses a single component developer constituted by toner only, toner is replenished into the development vessel so that the amount of toner contained in the development vessel is kept within a predetermined range.

Furthermore, in a development device that uses a two-component developer constituted by toner and a carrier, the concentration of toner in the two-component developer in the development vessel is detected and toner is replenished into the development vessel so that the proportion of toner present in the two-component developer is kept within a predetermined range.

Generally, a replenishment roller in a toner box that is detachably mounted in the development vessel is used to replenish toner into the development vessel. For example, in a development device that uses a two-component developer, whether there is an under toner condition or an over toner condition in the development vessel is detected by whether an output value of a toner concentration sensor such as a permeability sensor positioned in the development vessel is larger or smaller than a predetermined threshold. When an under toner condition occurs in the development vessel, the replenishment roller is rotated and toner is replenished into the development vessel so that the output value of the toner concentration sensor falls equal to or below the threshold.

Also, in a digital image forming apparatus disclosed in JP 2004-126219A, a toner usage amount to be used in image formation is calculated from a number of total pixels in an image and a per-pixel toner consumption amount, and toner is replenished to match the amount of toner to be used.

However, in conventional image forming apparatuses, toner replenishment to the development device is carried out by rotating the replenishment roller at an always constant rotational speed. That is, the toner replenishment amount per unit of time is constant regardless of the density of the image that is to be formed.

Thus, when consecutively carrying out image formation of low density images, there is a tendency for an over toner condition to occur in the development vessel, which causes a problem of fogging in the images. On the other hand, when consecutively carrying out image formation of high density images, there is a tendency for an under toner condition to occur in the development vessel, such that replenished toner is used in the development process without being sufficiently churned in, which causes a problem of white patches occurring in the image due to uncharged toner.

These problems can occur even during image formation of a single image when the density of the image to be formed differs greatly from the average density, such that replenishment of an amount of toner corresponding to the amount of toner to be used cannot be achieved, which incurs a problem of reduced image quality.

An object of the present invention is to provide a development device and a toner replenishment method capable of controlling a toner replenishment amount per unit of time using, as a reference, the amount of toner to be used based on image information of the image to be formed, capable of replenishing an appropriate amount of toner to the development vessel even when carrying out consecutive image formation of a plurality of images having different numbers of pixels and densities, and capable of maintaining good image quality by always keeping toner in an appropriately charged condition.

SUMMARY OF THE INVENTION

A development device according to the present invention is provided with a development vessel, a toner box, a toner amount detection sensor, and a control section. The development vessel accommodates toner to be supplied to an electrostatic latent image on an image carrier. The toner box replenishes toner into the development vessel. The toner amount detection sensor detects an amount of toner accommodated in the development vessel. The control section is configured to calculate an amount of toner to be used during image formation based on density information of an image to be formed and controls an amount per unit of time for replenishing toner from the toner box to the development vessel based on the calculated amount of toner to be used and the amount of toner accommodated detected by the toner amount detection sensor.

A toner replenishment method according to the present invention comprises a toner amount detection step, a toner usage amount calculation step, and a toner replenishment amount determination step. The toner amount detection step involves detecting an amount of toner accommodated in the development vessel. The toner usage amount calculation step involves calculating an amount of toner to be used during image formation corresponding to density information of an image to be formed. The toner replenishment amount determination step involves determining an amount per unit of time for replenishing toner from a toner box to the development vessel based on the amount of toner accommodated in the development vessel and the amount of toner to be used during image formation. The toner amount detection step, the toner usage amount calculation step, and the toner replenishment amount determination step are carried out prior to commencement of image formation.

DETAILED DESCRIPTION OF THE INVENTION

The following is a detailed description of an image forming apparatus to which a development device according to the best embodiment of the present invention has been applied, with reference to the accompanying drawings.

Figure 1:
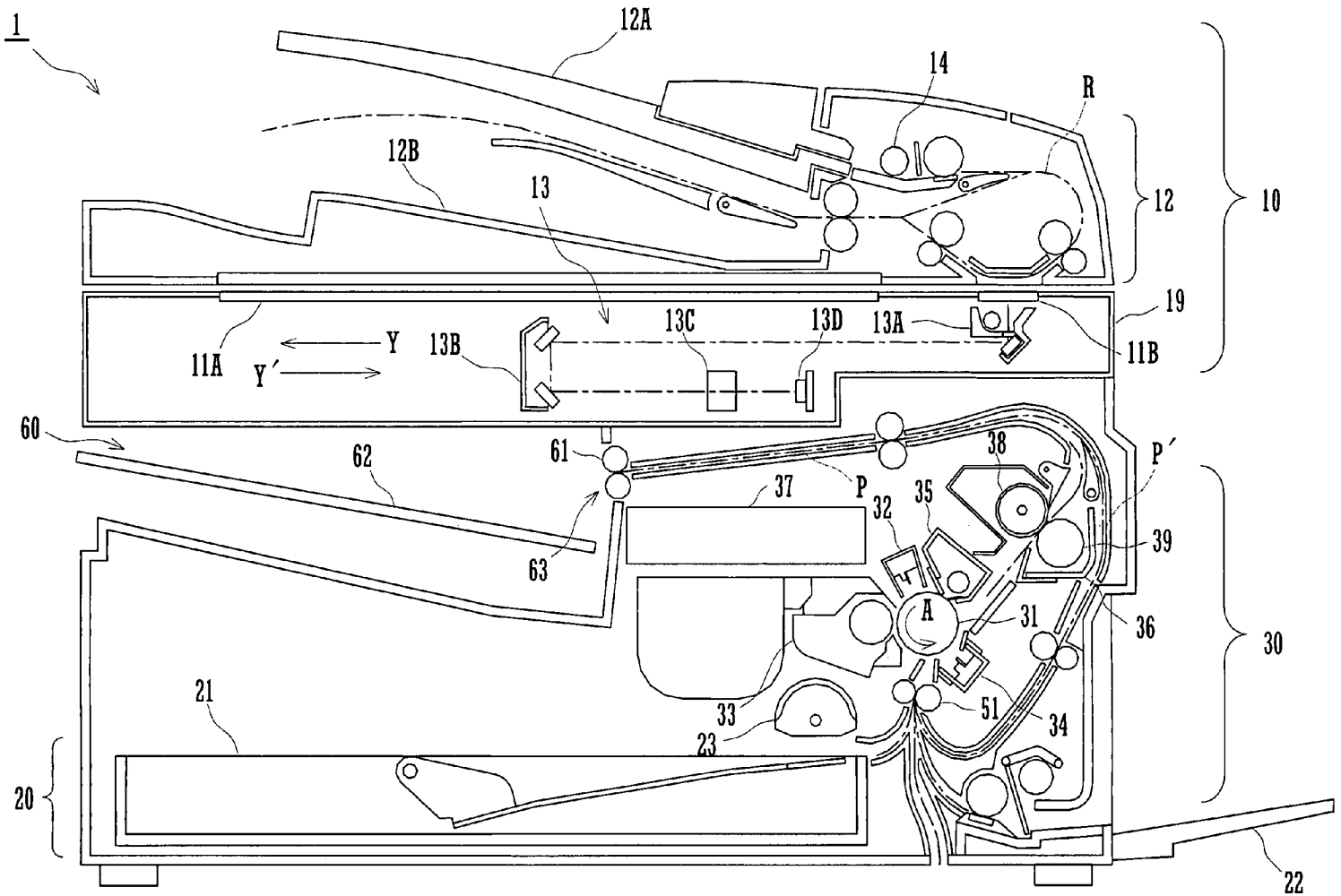
FIG. 1 is a front cross sectional view showing an outline structure of an image forming apparatus provided with a development device according to an embodiment of the present invention.

FIG. 1 is a front cross sectional view showing an outline structure of an image forming apparatus provided with a development device according to an embodiment of the present invention. An image forming apparatus 1 is provided with a copying function of forming an image that has been read from a document onto a recording medium. It should be noted that recording medium refers not only to paper but also to OHP and the like.

The image forming apparatus 1 is provided with a document reading section 10, a paper-supply section 20, an image-forming section 30, a paper discharge section 60, and an operation panel and the like not shown in the drawing. The document reading section 10 is positioned in an upper area of the image forming apparatus 1 and includes a document platen 11A, a sheet reading platen 11B, an automatic document feeder 12, and a reading unit 13.

The document platen 11A and the sheet reading platen 11B are provided so as to face the automatic document feeder 12 at an upper area of a casing 19, inside of which the reading unit 13 is arranged, and are constituted by transparent glass. Due to rotation of a feed roller 14, the automatic document feeder 12 carries sheet-form documents, which are accommodated on a document loading tray 12A, one by one onto the sheet reading platen 11B.

The automatic document feeder 12 is arranged above the document platen 11A and the sheet reading platen 11B and also functions as a document cover for selectively opening/closing an upper surface of the document platen 11A and the sheet reading platen 11B.

The reading unit 13 is provided with a mirror base 13A, a mirror base 13B, a lens 13C, and a solid-state image sensing device (hereinafter referred to as "CCD") 13D. The mirror base 13A moves back and forth in a horizontal direction supporting a light source lamp and a first mirror. The mirror base 13B moves in a horizontal direction at half the velocity of the mirror base 13A and supports a second mirror and a third mirror.

The light source lamp irradiates light onto an image surface of a document. The first to third mirrors deflect light reflected from the image surface of the document toward the lens 13C. The lens 13C focuses the reflected light that has been distributed via the first to third mirrors onto the CCD 13D.

In fixed reading mode, in which an image is read of a document placed on the document platen 11A, the mirror base 13A moves forward along a Y-arrow direction from a right edge area of the document platen 11A to positions opposing at least the entire surface of the document. During this time, the CCD 13D reads line by line in a main scanning direction an image of the document placed on the document platen 11A. Having reached the end edge of the document or the end edge of the document platen 11A, the reading unit 13 moves back along a Y'-arrow direction.

In sheet reading mode, in which an image is read of a sheet-form document that is carried from the document loading tray 12A of the automatic document feeder 12 onto the sheet reading platen 11B, the mirror base 13A is stationary in a position opposing the sheet reading platen 11B as shown in FIG. 1. A sheet-form document that has passed over the sheet reading platen 11B is discharged to a discharge tray 12B.

The CCD 13D receives light reflected from the image surface of the document and outputs electrical signals corresponding the amounts of light received. The electrical signals are converted to digital data as image data, then subjected to predetermined image processing and supplied to the image-forming section 30.

The paper-supply section 20 is positioned in a lower area of the image forming apparatus 1 and is provided with a supply tray 21, a manual loading tray 22, and a supply roller 23. The supply tray 21 and the manual loading tray 22 accommodate recording media. The supply roller 23 rotates to supply recording media accommodated in the supply tray 21 sheet by sheet.

The image-forming section 30 is positioned on the side of the manual loading tray 22 below the document reading section 10. The image-forming section 30 is provided with a laser scanning unit (hereinafter referred to as "LSU") 37, a photosensitive drum 31, and a fixing device 36. A charger 32, a development device 33, a transfer device 34, and a cleaning unit 35 are provided around the photosensitive drum 31 in this order along an A-arrow direction, which is a rotation direction of the photosensitive drum 31.

The photosensitive drum 31 rotates in the A-arrow direction during image forming. During this time, a predetermined electrical charge is applied uniformly by the charger 32 to the surface of the photosensitive drum 31, after which irradiation of an imaging light that is modulated by image data from the LSU 37 is received and an electrostatic latent image is formed due to a photoconductive effect. Following this, toner is supplied from the development device 33 and the electrostatic latent image is changed into a visible toner image on the surface of the photosensitive drum 31.

Registration rollers 51 are provided downstream from the supply roller 23 on a carry path P. The registration rollers 51 determine the timing by which the recording medium should be carried between the photosensitive drum 31 and the transfer device 34. Prior to the photosensitive drum 31 rotating, the recording medium that is supplied from the paper-supply section 20 is guided by the registration rollers 51 synchronized to the rotation of the photosensitive drum 31 to a position between the photosensitive drum 31 and the transfer device 34. The toner image that is carried on the surface of the photosensitive drum 31 is transferred to the surface of the recording medium by the transfer device 34. After transfer of the toner image is finished, the surface of the photosensitive drum 31 is brought into opposition to the cleaning unit 35 and residual toner is removed so that the photosensitive drum 31 can be used repetitively in image formation.

The fixing device 36 is provided with a heating roller 38 and a pressure roller 39. When a recording medium onto which a toner image has been transferred passes between the heating roller 38 and the pressure roller 39, it is subjected to heat and pressure. The temperature of the heating roller 38 is raised to a temperature at which the toner is meltable. When the recording medium passes between the heating roller 38 and the pressure roller 39, the toner image is melted and adheres to the surface of the recording medium.

The paper discharge section 60 is arranged in a vertical direction between the document reading section 10 and the paper-supply section 20, and is provided with, for example, paper discharge rollers 61 and a paper discharge tray 62. The paper discharge rollers 61 are positioned on an inner side of a discharge outlet 63 and discharge to the paper discharge tray 62 recording media that have been carried on the carry path P and passed through the fixing device 36.

The paper discharge rollers 61 are capable of forward and reverse direction rotation and at a time of double-sided image formation, in which image formation is carried out on both sides of the recording medium, the paper discharge rollers 61 sandwich the recording medium that is carried in on the carry path P then rotate in a reverse direction to the rotation direction for discharging the recording medium and carry the recording medium on a carry path P'. The carry path P' merges with the carry path P at a position downstream from the fixing device 36 on the carry path P and a position upstream from the registration rollers 51. The paper discharge tray 62 stacks and accommodates recording media that have undergone image formation and have been discharged from the discharge outlet 63 through the paper discharge rollers 61.

The paper discharge section 60 is open on a front side and a left side of the image forming apparatus 1. The paper discharge tray 62 of the paper discharge section 60 can be moved up and down according to the amount of recording media accommodated. The paper discharge tray 62 is positioned in a height position shown in FIG. 1 when no recording media are being accommodated, and lowers from the position shown in FIG. 1 along with increases in the amount of recording media accommodated.

Figure 2:
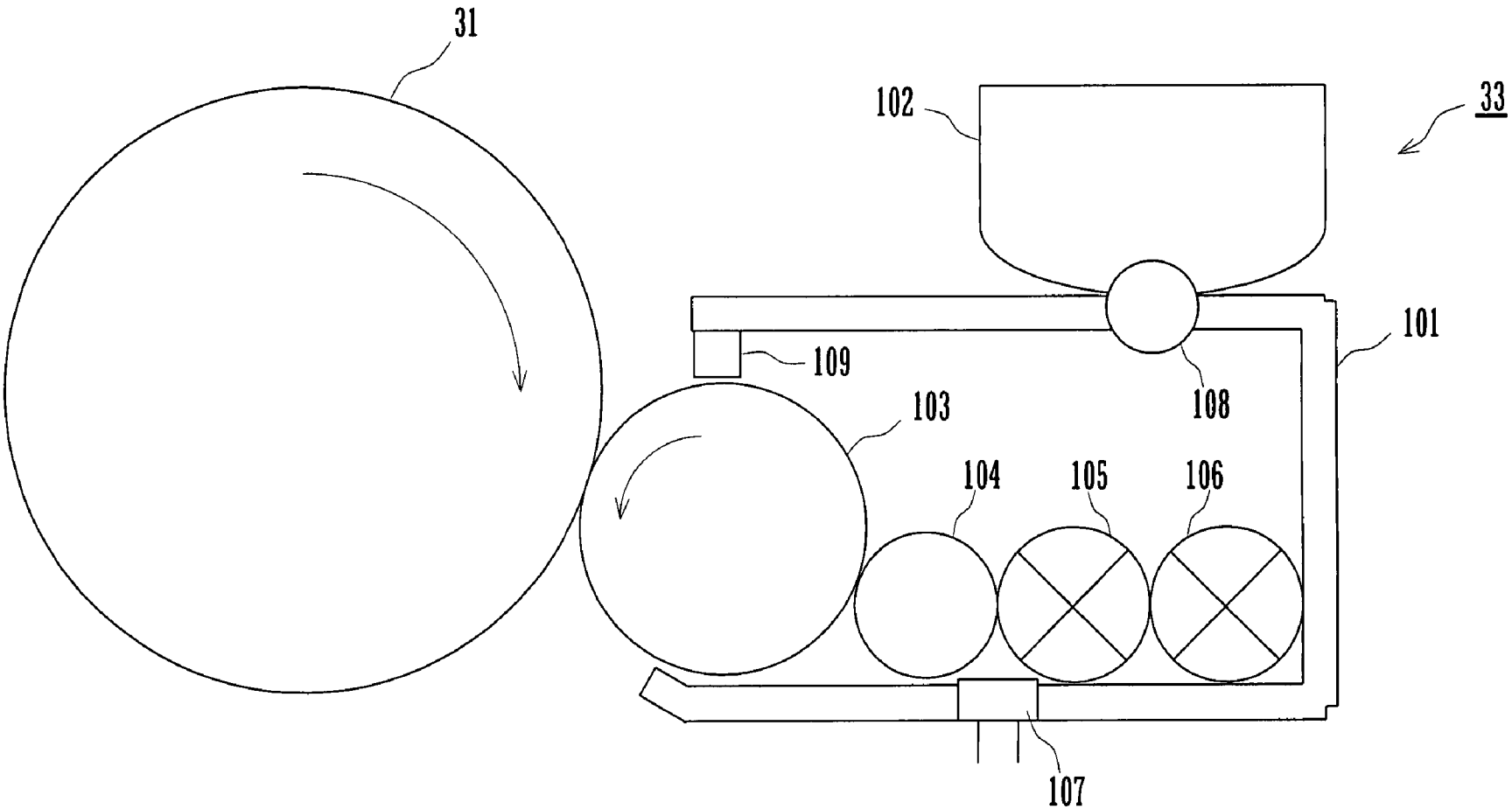
FIG. 2 shows a configuration of the development device.

FIG. 2 shows a configuration of the development device 33. The development device 33 includes a development vessel 101 and a toner box 102. The development vessel 101 is open on a side facing the photosensitive drum 31. A two-component developer made from a magnetic carrier and toner is accommodated inside the development vessel 101, wherein a development roller 103, a supply roller 104, and churning rollers 105 and 106 are axially supported. A toner concentration sensor 107 is also positioned in the development vessel 101. A doctor blade 109 is attached at an upper area of the open side.

The toner box 102 internally accommodates toner and is detachably mounted on an upper surface of the development vessel 101. The inside of the toner box 102 is in communication with the inside of the development vessel 101 via an open section at its bottom. A replenishment roller 108 is axially supported in this open section. As an example, the replenishment roller 108 may be a sponge roller. Toner inside the toner box 102 is replenished to the development vessel 101 by rotation of the replenishment roller 108.

The development roller 103 is a cylindrical sleeve internally provided with a magnetic pole and rotates while forming a magnetic brush of the developer on its peripheral surface by the magnetic field of the magnetic pole, thereby carrying developer to a development position. The development position is a position where the peripheral surface of the development roller 103 is closest to the surface of the photosensitive drum 31. The toner contained in the developer that is carried to the development position is adsorbed due to electrostatic force to the electrostatic latent image formed on the surface of the photosensitive drum 31. Thus, the electrostatic latent image is made into a visible toner image.

The supply roller 104 uses rotation to supply the developer inside the development vessel 101 to the peripheral surface of the development roller 103 and recovers developer that is residual on the surface of the development roller 103 after the development roller has passed the development position. The amount of developer that adheres to the surface of the development roller 103 is prescribed by the doctor blade 109. The churning rollers 105 and 106 use rotation to churn the magnetic carrier and toner that are contained inside the development vessel 101. Due to this churning, the toner is charged to a predetermined polarity and adsorbs to the surface of the magnetic carrier due to electrostatic force.

As an example, the toner concentration sensor 107 is a permeability sensor that outputs a voltage corresponding to the permeability of the two-component developer contained in the development vessel 101. Since toner is a non-magnetic substance, the permeability of the two-component developer decreases when the proportion of toner contained in the two-component developer increases, and the permeability of the two-component developer increases when the proportion of toner contained decreases. The toner concentration sensor 107 is a toner amount detection sensor of the present invention.

In the development steps in the image formation process, only toner is used in manifesting the electrostatic latent image and ideally the magnetic carrier should return to the development vessel 101 without adhering to the photosensitive drum 31. Consequently, the concentration of toner in the developer inside the development vessel 101 reduces due to repetition of the image formation process. A control section to be described later causes the replenishment roller 108 to rotate when the output value of the toner concentration sensor 107 becomes greater than a predetermined threshold and replenishes toner to the development vessel 101 so that the output signal of the toner concentration sensor 107 is maintained at a value equal to or below the predetermined threshold.

Figure 3:
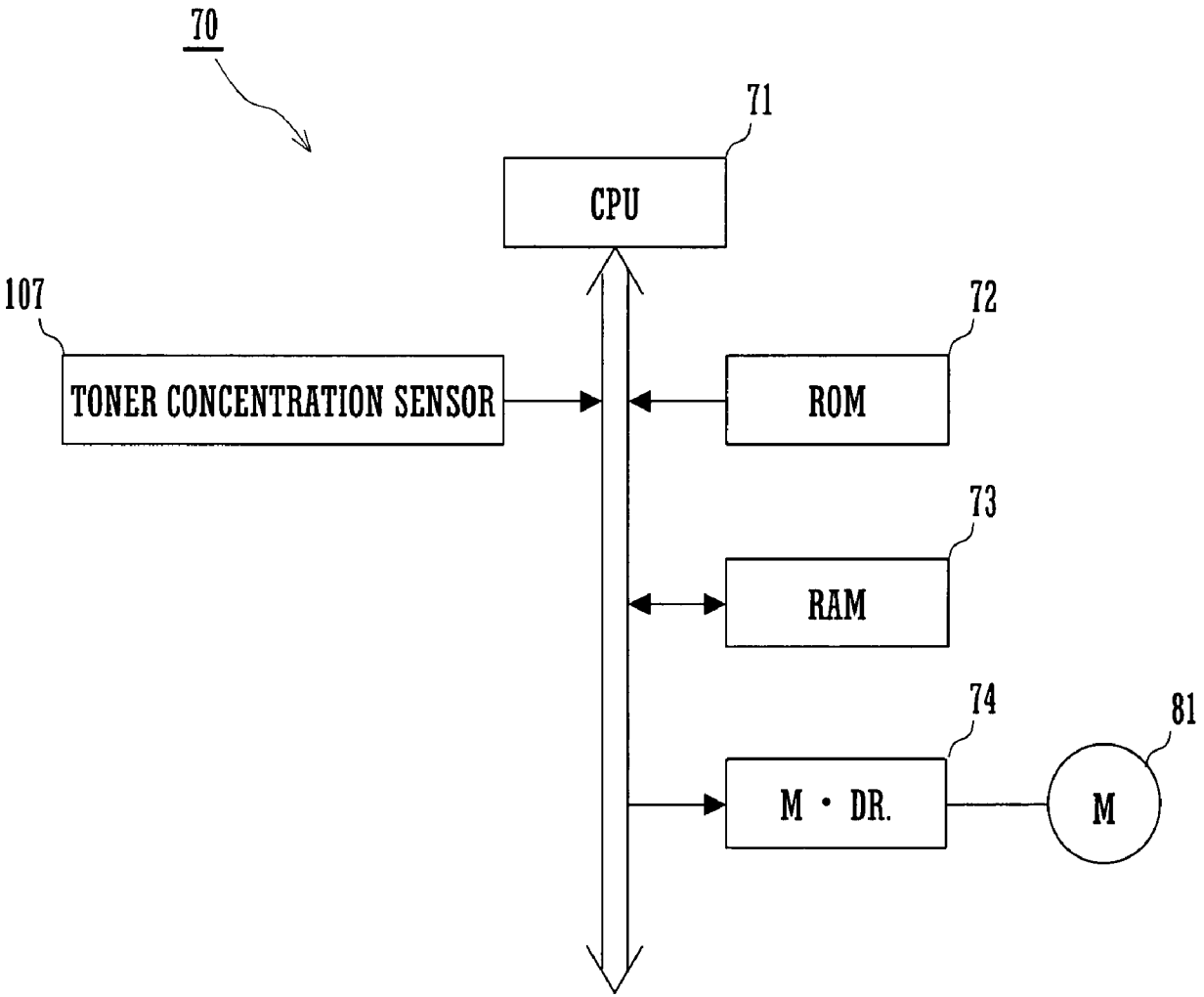
FIG. 3 is a block diagram showing a configuration of a portion of a control section of the image forming apparatus.

FIG. 3 is a block diagram showing a portion of a configuration of a control section 70 of the image forming apparatus 1. The control section 70 of the image forming apparatus 1 is configured such that a CPU 71 provided with a ROM 72 and a RAM 73 is connected to input-output devices such as a motor driver 74 and the toner concentration sensor 107. The control section 70 corresponds to the control section of the present invention.

The CPU 71 performs overall control of the input-output devices in accordance with a program prewritten into the ROM 72 and writes the input-output data to a predetermined memory area of the RAM 73. The toner concentration sensor 107 outputs to the CPU 71 a signal corresponding to the permeability of the two-component developer contained in the development vessel 101.

Based on the signal outputted by the toner concentration sensor 107, the CPU 71 supplies drive data to the motor driver 74. This drive data specifies a drive frequency that stipulates the rotational speed of a motor 81. The motor driver 74 drives the motor 81 based on the drive data supplied from the CPU 71. As an example, the motor 81 is a pulse motor and rotates the replenishment roller 108. In this case, the motor driver 74 drives the motor 81 using drive pulses of a duty ratio corresponding to the drive frequency specified by the drive data.

It should be noted that in this embodiment, the control section 70 of the image forming apparatus 1 is used as the control section, but a control section of the present invention other than the control section 70 can be provided to the development device 33.

Figure 4:
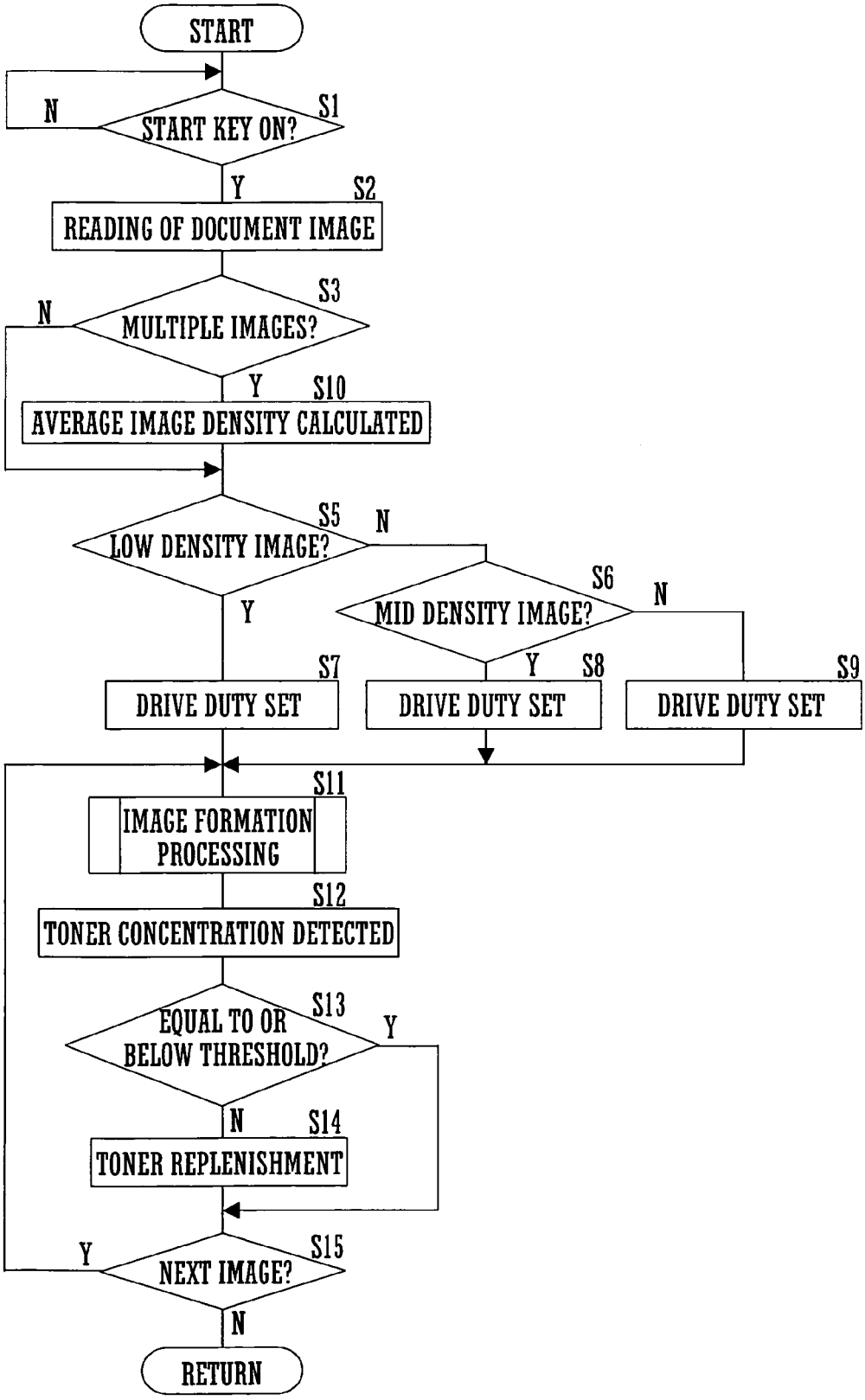
FIG. 4 is a flowchart for describing a first example of a processing procedure of the control section.

FIG. 4 is a flowchart for describing a first example of a processing procedure of the control section 70. The CPU 71 stands by (S1) for operation of a start key not shown in the drawing and carries out reading (S2) of an image of the document once the start key is operated. Next, the CPU 71 carries out a judgment (S3) as to whether or not multiple sheets of document are loaded and the requested image formation processing is consecutive image formation processing for multiple images.

When image formation processing is to be carried out for a single image, the CPU 71 sorts (S5 and S6) the image densities of the image that has been read from the document into three gradations for example and determines (S7, S8, and S9) drive duties of the motor 81 corresponding to low density, mid density, and high density respectively. When consecutive image formation processing is to be carried out, the CPU 71 calculates (S10) an average image density of the plurality of images and determines (S10→S5) any one of the drive duties of the three gradations based on the calculated average image density.

After this, the CPU 71 commences (S11) image formation processing based on the image that has been read. The CPU 71 carries out detection (S12) of the toner concentration during the execution of image formation processing based on the output signal of the toner concentration sensor 107 and when the output signal of the toner concentration sensor 107 is higher than the threshold (S13), the CPU 71 drives the motor 81 using the drive duty determined previously and replenishes toner (S14) using rotation of the replenishment roller 108. The CPU 71 repeats the processes of S11 to S14 until no image is left to be formed (S15).

Figure 5:
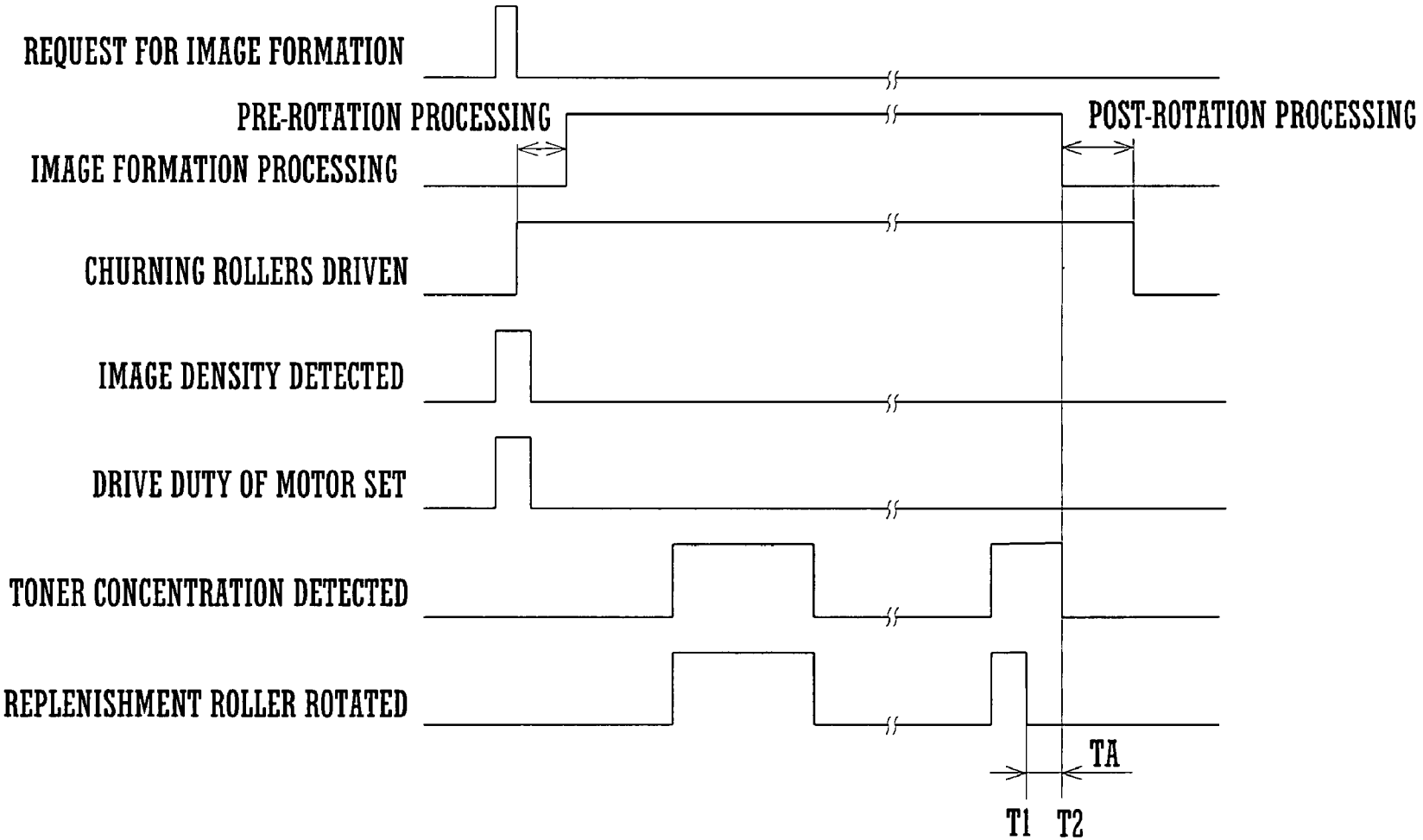
FIG. 5 is a diagram for describing a toner replenishment condition during an image formation process according to the first processing procedure.

Through the above-described processing, toner replenishment is carried out in a manner shown in FIG. 5 at the time of consecutive image formation processing. That is, when a request for image formation is inputted by operation of the start key, pre-rotation processing for the photosensitive drum 31 commences, rotation of the supply roller 104 and the churning rollers 105 and 106 commences in the development device 33, and homogenization and toner charging are carried out on the two-component developer contained in the development vessel 101. A judgment of image density is carried out during this pre-rotation processing and a drive duty ratio of the motor 81 is determined based on the judgment result.

For example, pixel percentages are obtained for image densities from the proportions of black pixels in the images, and an image having a pixel percentage of 60% to 100% is set as a high density image, an image having a pixel percentage of 20% to 59% is set as a mid density image, and an image having a pixel percentage of 0% to 19% is set as a low density image. Then, the drive duty of the motor 81 is set to 70% for high density images, 30% for mid density images, and 10% for low density images.

After this, image formation processing commences and when a reduction in toner concentration in the developer is detected during image formation processing, the motor 81 is driven by the drive duty that has been set and the replenishment roller 108 is made to rotate at a rotational speed corresponding to the image density. Thus, toner can be replenished to the development vessel 101 in a replenishment amount per unit of time corresponding to the amount of toner consumed per unit of time.

Figure 6:
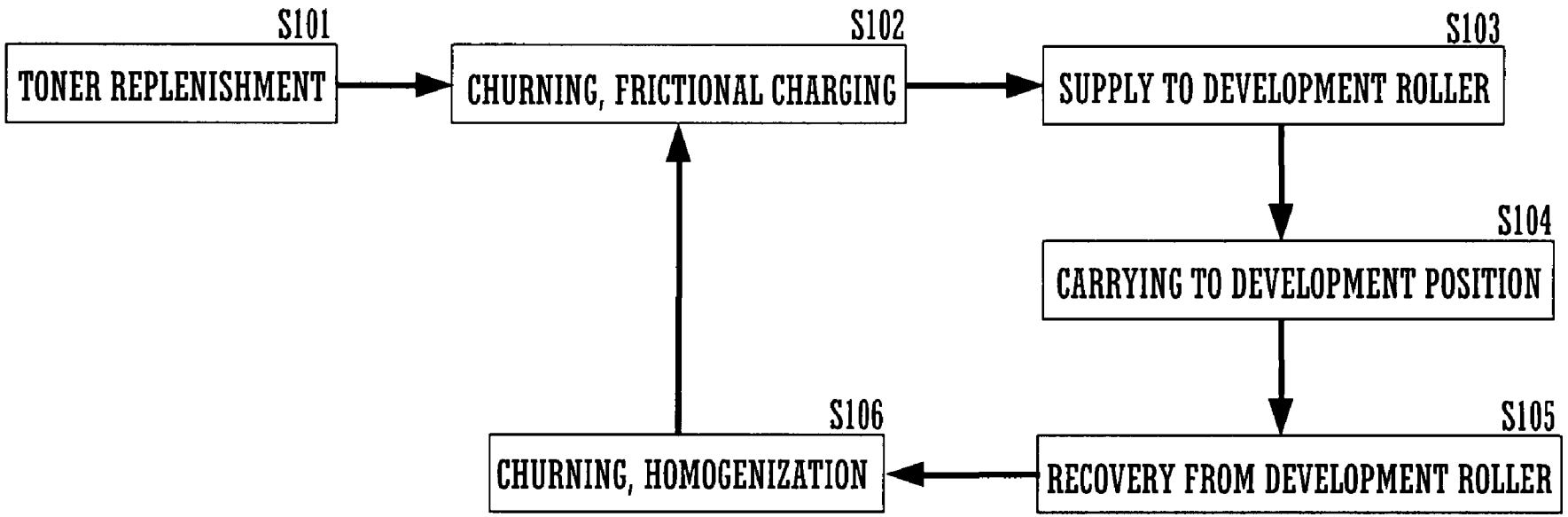
FIG. 6 is a diagram for describing a toner condition in the development vessel of the development device.

Here, a condition of the toner inside the development vessel 101 is described using FIG. 6. When the output signal of the toner concentration sensor 107 exceeds the predetermined threshold, toner is replenished (S101) from the toner box 102 to the development vessel 101 by rotation of the replenishment roller 108 as described above. The toner replenished from the toner box 102 is churned with the magnetic carrier due to the rotation of the churning rollers 105 and 106 and charged (S102) to a predetermined polarity due to friction with the magnetic carrier.

Toner that has been charged to the predetermined polarity is supplied (S103) along with magnetic carrier to the development roller 103 by the rotation of the supply roller 104 and carried (S104) to the development position via the peripheral surface of the development roller 103. Toner that has not adhered to the surface of the photosensitive drum 31 at the development position is recovered (S105) along with the magnetic carrier from the peripheral surface of the development roller 103 by the supply roller 104, and the toner and the magnetic carrier inside the development vessel 101 are churned (S106) by the rotation of the churning rollers 105 and 106. Thus, the concentration of toner in the two-component developer is made uniform.

When the output signal of the toner concentration sensor 107 is equal to or below the predetermined threshold, the processes of S102 to S106 are repeated and, ideally, the time required to complete the processes of S102 to S106 is about several seconds.

However, time is required to some extent to churn using the churning rollers 105 and 106. Also, a portion of the two-component developer that has adsorbed to the peripheral surface of the development roller 103 is scraped off by the doctor blade 109 before being carried to the development position. Further still, a portion of the two-component developer residual on the peripheral surface of the development roller 103 that has passed the development position continues to be residual without being separated by the supply roller 104. For these reasons, time is required to complete the processes of S102 to S106 and generally several tens of seconds are actually required. This time varies according to the processing speed in image formation processing of the image forming apparatus 1.

Consequently, replenishment of toner from the toner box 102 to the development vessel 101 does not reflect directly onto the concentration of toner in the two-component developer in the development vessel 101. After the toner concentration is detected as being low from the output signal of the toner concentration sensor 107 until the concentration of toner in the two-component developer in the development vessel 101 is restored by replenishing toner requires a certain amount of time.

Therefore, at least during consecutive image formation, the threshold of the output signal of the toner concentration sensor 107 is set lower than a value corresponding to an ideal value of toner concentration. At the point in time when the output signal of the toner concentration sensor 107 exceeds the threshold, rotation of the replenishment roller 108 is commenced and toner replenishment is commenced in advance before the toner concentration falls below the ideal value.

Toner replenishment finishes when the toner concentration has been restored to the ideal value. At this time, if toner replenishment continues until image formation processing for the final image is completed, toner replenished immediately prior to the finish of replenishment is present in the development vessel 101 without being sufficiently churned, and using this toner in an uncharged condition for the next image formation process incurs a reduction in image quality. Therefore, during image formation processing for the final image in consecutive image formation processing, even when the output signal of the toner concentration sensor 107 has not been restored to equal to or below the threshold, toner replenishment is stopped at a time T1, which is a predetermined time TA prior to a time T2 at which image formation processing finishes for the final image.

It should be noted that how low the threshold should be set corresponding to the ideal value of toner concentration may be set to vary in response to the average image density of the plurality of images to be formed in consecutive image formation processing. Compared to when the average image density is low, the threshold is set even lower than the value corresponding to the ideal value of toner concentration when the average image density is high.

Furthermore, the threshold can be set using, as a reference, the threshold at the time when the average image density is high so that when the average image density is low, by an amount of time corresponding to the extent of the low density, the commencement of rotation of the replenishment roller 108 from the point in time at which the output signal of the toner concentration sensor 107 exceeds the threshold can be delayed.

Further still, the predetermined time in finishing toner replenishment prior to completion of image formation processing for the final image may be varied in response to the average image density, and the predetermined time may be set even longer when the average image density is high compared to when the average image density is low.

Figure 7:
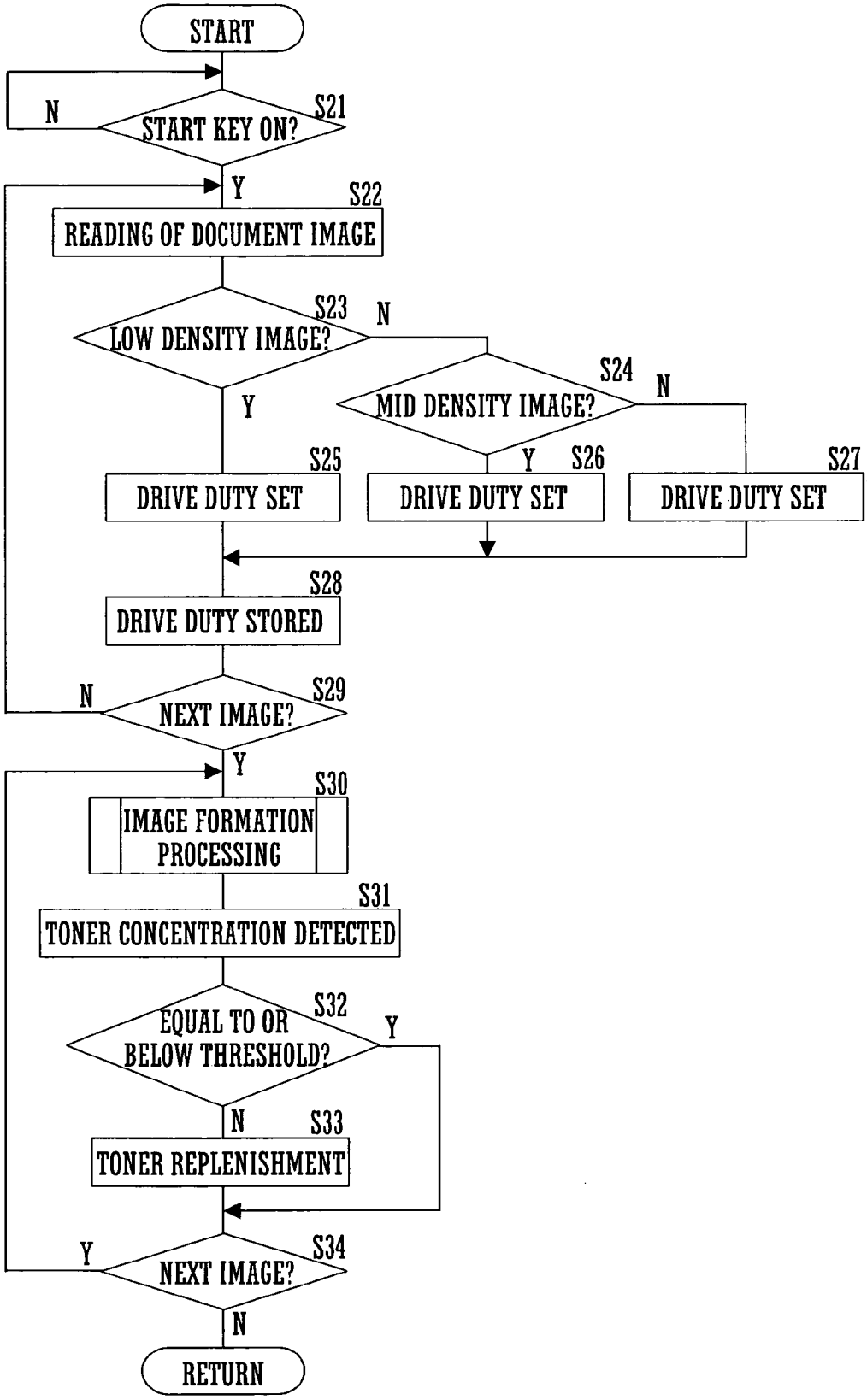
FIG. 7 is a flowchart for describing a second example of a processing procedure of the control section.

FIG. 7 is a flowchart for describing a second example of a processing procedure of the control section 70. The CPU 71 stands by (S21) for operation of a start key not shown in the drawing and carries out reading (S22) of an image from the document once the start key is operated. Next, the CPU 71 sorts (S23 and S24) the image densities of the images that have been read from the document into three gradations for example and determines (S25, S26, and S27) drive duties of the motor 81 corresponding to low density, mid density, and high density respectively, and stores (S28) the determined drive duties for each image in a predetermined memory area of the RAM 73. Accordingly, when consecutive image formation processing is to be carried out, the CPU 71 stores (S29→S22) any one of the three gradations of drive duties for each of the plurality of images.

After this, the CPU 71 commences (S30) image formation processing based on the image that has been read. The CPU 71 carries out detection (S31) of the concentration of toner based on the output signal of the toner concentration sensor 107 during the execution of image formation processing. When the output signal of the toner concentration sensor 107 is higher than the threshold (S32), the CPU 71 reads out the drive duty of the corresponding image from the RAM 73 to drive the motor 81 and carries out toner replenishment (S33) by rotation of the replenishment roller 108. The CPU 71 repeats the processes of S30 to S34 until no image is left to be formed (S34).

Figure 8:
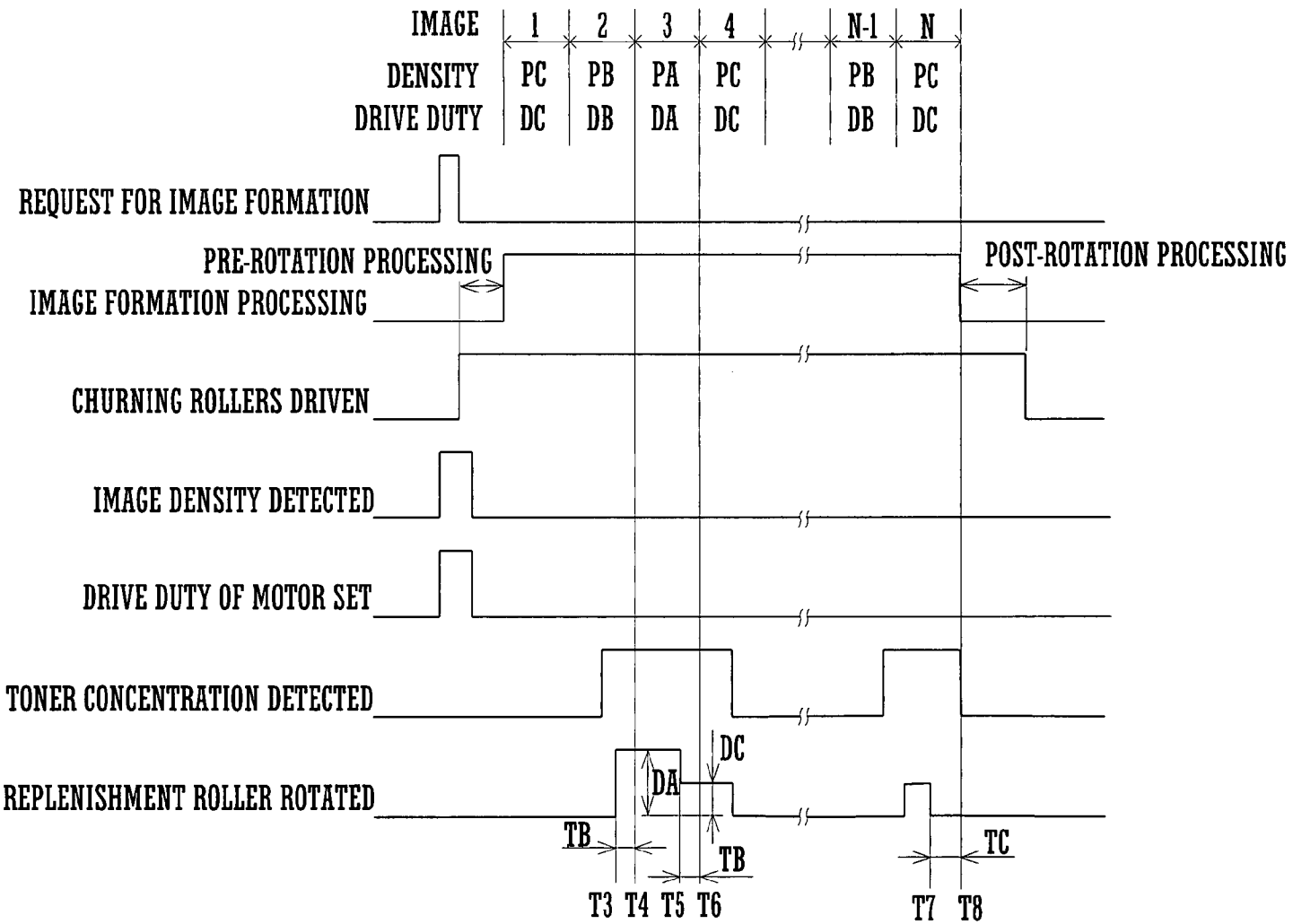
FIG. 8 is a diagram for describing a toner replenishment condition during an image formation process according to the second processing procedure.

Through the above-described processing, toner replenishment is carried out in a manner shown in FIG. 8 at the time of consecutive image formation processing. That is, when there is a request for image formation by operation of the start key, pre-rotation processing for the photosensitive drum 31 commences, rotation of the supply roller 104 and the churning rollers 105 and 106 commences in the development device 33, and homogenization and toner charging are carried out on the developer contained in the development vessel 101. A judgment of image density is carried out during this pre-rotation processing and a drive duty ratio of the motor 81 is determined based on the judgment result.

For example, pixel percentages are obtained for image densities from the proportions of black pixels in the images, and an image having a pixel percentage of 60% to 100% is set as a high density image, an image having a pixel percentage of 20% to 59% is set as a mid density image, and an image having a pixel percentage of 0% to 19% is set as a low density image. Then, the drive duty of the motor 81 is set to 70% for high density images, 30% for mid density images, and 10% for low density images.

After this, image formation processing commences and when a reduction in toner concentration in the developer is detected during image formation processing, the motor 81 is driven by the drive duty that has been set and the replenishment roller 108 is made to rotate at a rotational speed corresponding to the image density, thereby enabling toner to be replenished to the development vessel 101 in a replenishment amount per unit of time corresponding to the amount of toner consumed per unit of time.

As described earlier using FIG. 6, after the toner concentration is detected as being low from the output signal of the toner concentration sensor 107, a certain amount of time is required until the concentration of toner in the developer in the development vessel 101 is restored by the replenishment of toner.

Therefore, at least during consecutive image formation, the threshold of the output signal of the toner concentration sensor 107 is set lower than a value corresponding to an ideal value of toner concentration. At the point in time when the output signal of the toner concentration sensor 107 exceeds the threshold, rotation of the replenishment roller 108 is commenced a predetermined time before the next image formation processing is commenced using a drive duty that has been set for the image targeted for image formation processing subsequent to the image formation processing currently being executed. Replenishment of toner of an amount to be used for the subsequent image formation processing is commenced in advance before the concentration of toner falls below the ideal value.

For example, in FIG. 8, when the output signal of the toner concentration sensor 107 exceeds the threshold during image formation processing for the second image, driving of the motor 81 is commenced with a drive duty DA corresponding to an image density PA of the third image at a time T3, which is a predetermined time TB prior to a time T4 at which image formation processing for the third image commences.

When the condition in which the output signal of the toner concentration sensor 107 exceeds the threshold continues even during the image formation processing for the third image, driving of the motor 81 is commenced with a drive duty DC corresponding to an image density PC of the fourth image at a time T5, which is the predetermined time TB prior to a time T6 at which image formation processing for the fourth image commences.

Toner replenishment finishes at the point in time when the output signal of the toner concentration sensor 107 has been restored to the threshold. At this time, if toner replenishment continues until image formation processing for the final image is completed, toner replenished immediately prior to the finish of replenishment is present in the development vessel 101 without being sufficiently churned, and using this toner in an uncharged condition for the next image formation process incurs a reduction in image quality. Therefore, during image formation processing for the final image in consecutive image formation processing, even when the detection value of the toner concentration sensor 107 has not been restored to the threshold level, toner replenishment is stopped at a time T7, which is a predetermined time TC prior to a time T8 at which image formation processing finishes for the final image.

How low the threshold should be set with respect to the ideal value of toner concentration may be set to vary in response to the density of the image to be formed in the next image formation processing. For example, when the average image density is high, the threshold is set even lower compared to when the image density is low.

Furthermore, the threshold can be set using, as a reference, the threshold at the time when the image density is high so that when the image density is low, by an amount of time corresponding to the extent of the low density, the commencement of rotation of the replenishment roller 108 from the point in time at which the output signal of the toner concentration sensor 107 exceeds the threshold can be delayed.

Further still, the predetermined time TB for stopping toner replenishment prior to completion of image formation processing may be set to vary in response to the image density of the image to be formed in the final image formation processing. When the image density of the image to be formed in the final image formation processing is high, the predetermined times TB and TC are set even longer compared to when the image density is low.

It should be noted that the processes shown in FIGS. 4 and 7 are described using as an example a case in which image formation processing is carried out on images read from a document in the document reading section 10 of the image forming apparatus 1, but the present invention can be applied in the same manner when carrying out image formation processing with regard to image information inputted from an external device such as a personal computer or a scanner.

Furthermore, the present invention can be applied in the same manner for an image forming apparatus that uses a single component developer constituted by toner only.

Finally, the above-described embodiments of the present invention should be considered illustrative examples in every respect and not as limitations. The scope of the present invention is indicated by the claims and not the above-described embodiments. Furthermore, all changes which come within the meaning and range of equivalency of the claims are intended to be embraced in the scope of the invention.

What is claimed is:

1. A development device, comprising: a development vessel for accommodating toner to be supplied to an electrostatic latent image; a toner box for replenishing toner into the development vessel; a toner amount detection sensor for detecting an amount of toner accommodated in the development vessel; and a control section configured to determine an amount per unit of time for replenishing toner from the toner box to the development vessel based on an amount of toner to be used during image formation calculated based on density information of an image to be formed and the amount of toner accommodated detected by the toner amount detection sensor.

2. The development device according to claim 1, wherein the control section is configured to determine a commencement timing for replenishing toner based on the amount of toner accommodated and the amount of toner to be used.

3. The development device according to claim 1, wherein the control section is configured to determine a timing for finishing toner replenishment based on the amount of toner accommodated and the amount of toner to be used.

4. The development device according to claim 2, wherein the control section is configured to determine a timing for finishing toner replenishment based on the amount of toner accommodated and the amount of toner to be used.

5. The development device according to claim 1, wherein the toner box comprises a replenishment roller for replenishing toner to the development vessel and the control section determines a rotational speed of the replenishment roller as the amount per unit of time for replenishing toner.

6. The development device according to claim 5, further comprising a pulse motor for rotating the replenishment roller, wherein the control section is configured to vary the rotational speed of the pulse motor by controlling a drive frequency.

7. A toner replenishment method wherein the following steps are executed prior to commencement of image formation processing: a toner amount detection step of detecting an amount of toner accommodated in a development vessel, a toner usage amount calculation step of calculating an amount of toner to be used during image formation corresponding to density information of an image to be formed, and a toner replenishment amount determination step of determining an amount per unit of time for replenishing toner from a toner box to the development vessel based on the amount of toner accommodated in the development vessel and the amount of toner to be used during image formation.

8. A toner replenishment method wherein the following steps are executed prior to commencement of image formation processing: a toner amount detection step of detecting an amount of toner accommodated in a development vessel, a toner usage amount calculation step of calculating an amount of toner to be used during image formation corresponding to density information of an image to be formed, and a toner replenishment condition determination step of determining an amount per unit of time for replenishing toner from a toner box to the development vessel and a timing for commencing toner replenishment based on the amount of toner accommodated in the development vessel and the amount of toner to be used during image formation.

9. A toner replenishment method wherein the following steps are executed prior to commencement of image formation processing: a toner amount detection step of detecting an amount of toner accommodated in a development vessel, a toner usage amount calculation step of calculating an amount of toner to be used during image formation corresponding to density information of an image to be formed, and a toner replenishment condition determination step of determining an amount per unit of time for replenishing toner from a toner box to the development vessel and a timing for finishing toner replenishment based on the amount of toner accommodated in the development vessel and the amount of toner to be used during image formation.

* * * * *